US006401481B2

(12) United States Patent
Hiraoka et al.

(10) Patent No.: US 6,401,481 B2
(45) Date of Patent: Jun. 11, 2002

(54) REFRIGERATOR AND METHOD OF OPERATING REFRIGERATOR

(75) Inventors: Toshie Hiraoka; Keiji Ohya, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/956,426

(22) Filed: Sep. 20, 2001

Related U.S. Application Data

(62) Division of application No. 09/594,441, filed on Jun. 14, 2000.

(30) Foreign Application Priority Data

Sep. 9, 1999 (JP) ..... 11-255543
Dec. 24, 1999 (JP) ..... 11-366517

(51) Int. Cl.[7] ..... F25D 17/06
(52) U.S. Cl. ..... 62/407; 62/438; 62/382
(58) Field of Search ..... 62/407, 408, 409, 62/410, 411, 412, 426, 441, 430, 437, 438, 382

(56) References Cited

U.S. PATENT DOCUMENTS 2,049,708 A * 8/1936 Lieb ..... 62/438
4,557,118 A * 12/1985 Pink et al. ..... 62/408 X
4,751,826 A * 6/1988 Kawahara et al. ..... 62/382
4,951,481 A * 8/1990 Negishi ..... 62/438 X
5,983,654 A 11/1999 Yamamoto et al. ..... 62/187
6,055,826 A 5/2000 Hiraoka et al. ..... 62/408
6,314,746 B2 11/2001 Ohya et al. ..... 62/187

* cited by examiner

*Primary Examiner*—Harry B. Tanner
(74) *Attorney, Agent, or Firm*—Oblon, Spivak, McClelland, Maier & Neustadt, P.C.

(57) ABSTRACT

A temperature controller is in a position at a height of 130 cm or more from a base surface settling, of which the refrigerator is settled, on a door of the refrigerator, which position is on an upper side of a handle for opening and closing the door. Further, a minute control depending on a preserving condition of foods, the seasons, a quantity of the foods, and so on is made possible. Further, a quick cooling time can be set; and a heat storage tray is installed inside the refrigerator, whereby a temperature inside the refrigerator and the foods are not affected even though warm or hot foods are stored, whereby checking and setting of the temperature become easy; the temperature controller and a display portion thereof are prevented from destroying; playing with a refrigerator by children and so on are avoidable; the foods can be further stably stored; a labor time for house holding is reduced; an energy saving capability is enhanced; and a food value is maintained to make a person ingest a higher food value.

1 Claim, 15 Drawing Sheets

REFRIGERATOR AND METHOD OF OPERATING REFRIGERATOR

This application is a Division of application Ser. No. 09/594,441 filed on Jun. 14, 2000.

BACKGROUND OF THE INVENTION

1. Field of the Invention

The present invention relates to a display portion of a refrigerator and a rapid refrigerating function.

2. Discussion of Background

FIG. 10 is a front view of a conventional refrigerator. FIG. 11 is a cross-sectional view of FIG. 10 for illustrating an inside of the conventional refrigerator. In FIGS. 10 and 11, the refrigerator is constructed by a freezing chamber 5, a refrigerating chamber 1, a chilling chamber 10, and a vegetable chamber 4. Numerical reference 6 designates a handle as a secure hand, formed on a door of the refrigerator. Numerical reference 11 designates a temperature controller, formed on a back surface of the refrigerating chamber 1. Therefore, in order to access the temperature controller for controlling a temperature inside the refrigerator 1, it is necessary to widely open the door, wherein an increment of the temperature inside the refrigerator is caused and a hand cannot be easily reached to the back surface of the refrigerating chamber 1. Further, a current setting can be checked by opening and closing the door, whereby the temperature controller is not easily used.

FIG. 12 illustrates a conventional refrigerator having a structure similar to that described in FIGS. 10 and 11. This conventional refrigerator is constructed by a freezing chamber 5, a refrigerating chamber 1, a chilling chamber 10, and a vegetable chamber 4, wherein a temperature controller 11 is located on a front surface of a door for the freezing chamber 5.

Even though the temperature controller 11 is located outside the refrigerator, not inside this, the position of the temperature controller is not in alignment with an eye line and is not observed without unconsciousness. Therefore, in cases that a setting is not appropriate and a temperature increment inside the refrigerator is displayed, adjustments are not sufficiently quick to avoid an influence to freshness of foods. Further, because the temperature controller 11 is located in the freezing chamber 5, not like the temperature controller 11 in the refrigerating chamber 1 illustrated in FIGS. 10 and 11, there is a temperature difference from an outer air of about −18° C. Therefore, frost is generated when a sufficient thermal insulation in not realized at where the temperature controller 11 is located. Adversely, in case that a sufficient thermal insulation is realized, there are problems that the temperature controller 11 protrudes from the door surface to affect a design, an adjustment of the temperature is changed at time of opening and closing the door by striking against walls, furnitures and so on, and similar situations to those described above occurs.

FIG. 13 illustrates a conventional refrigerator, constructed by a refrigerating chamber 1, a vegetable chamber 4, and a pair of vertically arranged freezing chambers 5, wherein a temperature controller 11 is located in the refrigerating chamber 1. Although the temperature controller 11 is located at a lower position of the refrigerator than that in FIG. 12, children easily operate the temperature controller 11 to erroneously change a temperature setting, whereby there is a possibility that foods are frozen or rotted.

FIG. 14 illustrates a conventional refrigerator constructed by a refrigerating chamber 1, a vegetable chamber 4, and a freezing chamber 5 from up to down, wherein a temperature controller 11 is located in the refrigerating chamber 1. Although the temperature controller 11 is located on an upper portion of the door in an uppermost stage of the refrigerator having a low height. Although this position of the temperature controller 11 is easily accessible at time of using the refrigerator, because electronical components such as a board is included in the temperature controller, there are many cases that the refrigerator is damaged under a packed state by a pressure, and various objects are put on a top of the refrigerator because of its low height, whereby problems such that the refrigerator is destroyed by a collision with an object, and moisture intrudes into the refrigerator.

Further, in a case that the refrigerator is installed along a wall and cases similar thereto, because the temperature controller 11 is located in upper and lower portions and so on of a center of the door, as illustrated in FIGS. 10, 11, 12, a display portion is occasionally destroyed by striking against a wall, a pillar and so on at time of opening the door. Therefore, it is necessary to cover using a lid and so on, and provide a locking mechanism for the door and other means similar thereto.

FIG. 15 is a detailed view of the temperature controller 11, illustrated in, for example, FIGS. 10 through 14. In the figures, numerical reference 11*a* designates an LED display portion for showing a state of temperature control. Numerical reference 11*b* designates a switch for controlling the temperature control. The temperature controller 11 is horizontally extending for separately serve by each chamber of the refrigerator. The temperature controller 11 is constructed by LED display portions 11*a* and switch portions 11*b*, both respectively corresponding to the chambers. However, such an arrangement of the LED display portions 11*a* and the switch portions 11*b* can not be easily distinguished because only labels of a freezing chamber temperature control, a refrigerating chamber temperature control, and a chilling chamber temperature control are displayed, whereby there is a possibility that a wrong chamber is erroneously controlled because it is not instinctively know which label corresponds to which chamber. Further, because the switch portion 11*b* is arranged adjacent to the LED display portion 11*a*, and the switch portions 11*b* are arranged on left and right sides of the LED display portion 11*a*, a hand of an operator covers the LED display portion 11*a* at time of controlling the temperature, and the operator can not observe the LED display portion 11*a*, whereby the operation is difficult.

FIG. 16 illustrates a relationship between a display of a set condition in a function of setting the temperature by the temperature controller 11 and a range of temperature changes with respect to a medium mode indicator in the temperature controller. In FIG. 16, an abscissa represents a content of the display by the LED display portion 11*a* of the temperature controller 11, and an ordinate represents the range of the temperature change [deg] with respect to the medium mode in setting the temperature. For example, when the LED display portion 11*a* indicates a low mode, a temperature higher than the medium mode by 3° C. is set. In this case, there is one step between the medium mode and the low mode. Therefore, it is possible to set temperatures higher and lower than the medium mode by 1.5° C. When it is required to minutely set the temperature less than 1.5° C., the LED display should be expanded. However, there is no sufficient space for expanding the LED display, a cost therefor is increased; and a more minute control can not be attained for food to be easily frozen. In order to avoid the freezing of the foods, it is always necessary to increase the temperature by 1.5° C. or more, whereby a keeping quality is deteriorated. Adversely, when it is required to cool the foods, these are excessively cooled, whereby an energy can not be saved.

In a conventional refrigerators, when a large amount of foods are stored into the refrigerator at time of purchasing the large amount of foods and under a situation similar thereto, for example, a high mode is selected in the temperature controller 11 so as to quickly cool the foods for rapidly decreasing the temperature. However, in such a case, foods like tofu especially containing much moisture are apt to freeze because the temperature setting is still low after quickly cooling the foods. Thus there is a problem that an electric power consumption is useless.

The conventional refrigerator is cooled by detecting the temperature inside the refrigerator by a temperature sensor for detecting the temperature and cooling when the detected temperature is higher than a set temperature to control to bring the temperature into the set temperature. When a heated food is accommodated in the refrigerator, the temperature detected by the temperature sensor is increased by a heat from the heated food, wherein a cooling operation is started. At this time, foods, stored in the refrigerator, are influenced by the heat as in the temperature sensor, whereby a temperature of the foods is increased and freshness of the foods is deteriorated.

Further, at time of cooking a cold desert, such as an ice cream, in use of the conventional refrigerators, materials such as daily cream, sugar, eggs and so on are mixed and inserted into the freezing chamber 5 for cooling. After freezing to a certain extent, the materials are once whipped to make the materials contain an air, and thereafter the materials are cooled in the freezing chamber 5. Such an operation is repeated so that the cool desert is not hardened after being finally frozen.

Since the conventional refrigerators are constructed as described above, it is necessary to open and close the door of the refrigerator and, when necessary, foods should be moved for controlling the temperature through the switch portion 11*b* of the temperature controller; and the door should be kept opened for the temperature control, whereby freshness is deteriorated by an increment of the temperature in the refrigerator, and as a result, the temperature of the foods increase. Further, the inside of the refrigerator is insufficiently cooled or excessively cooled, since the temperature controller 11 is located in a position hardly observed, and therefore it is not possible to quickly check the temperature controller to resultantly delay an adjustment, whereby there are problems that the foods rotted or frozen.

Further, even though the temperature controller 11 is located outside the refrigerator, there are problems that it is not easily checked depending on its position, and children controls it. By an impact at time of opening and closing the door, the temperature controller 11 is broken and becomes inoperable. Further, there are problems that the display portion 11*a* is hidden by a hand at time of controlling the controller, and a wrong chamber is erroneously controlled, whereby the foods are frozen or rotted in a manner similar to describe above. Further, it is impossible to minutely adjust the temperature controller in conventional refrigerators since the adjustment by each interval of 1.5° C. is only possible. Therefore, it is difficult to control so that foods containing much moisture and so on are preserved at a low temperature for keeping freshness and avoiding freezing, and therefore the temperature is set to be a bit higher than required for avoiding the freezing, whereby deterioration of the freshness is caused.

Further, when it is required to easily cook a home made desert without additives such as an ice cream, it is necessary to spend a time for frequently taking the ice cream under cooking out of the inside of the refrigerator, stirring for smoothing, and freezing, whereby a freezing rate is high, a touch is not comfortable, and a taste is not good despite the cooking time.

SUMMARY OF THE INVENTION

It is an object of the present invention to solve the above-mentioned problems inherent in the conventional technique and to provide a refrigerator having a temperature controller at a position where a temperature inside the refrigerator can be easily set and checked from time to time, and children and so on can not play with the temperature controller. Further, a minute temperature control becomes possible; a quick freezing function is provided; and a temperature range of facilitating softly freezing an ice cream and so on is obtainable.

According to the first aspect of the present invention, there is provided a refrigerator comprising a refrigerating chamber on an upper stage, and a temperature controller having a function of setting a temperature inside the refrigerator, located on a door of the refrigerator covering a front surface of the refrigerator, wherein the height of the temperature controller is in a level of eyes of users of 130 cm or more from an installing surface of the refrigerator.

According to a second aspect of the present invention, there is provided a refrigerator comprising a refrigerating chamber located on an upper stage, and a temperature controller having a function of setting a temperature inside the refrigerator located on a door of the refrigerator covering a front surface of the refrigerator, wherein a position of the temperature controller is other than upper and lower ends of the door.

According to a third aspect of the present invention, there is provided a refrigerator comprising a temperature controller having a control portion for setting a set temperature and a display portion for displaying the set temperature, wherein the temperature controller is located in an upper portion of a secure hand being grasped by hands of users at time of opening and closing a door of the refrigerator.

According to a fourth aspect of the present invention, there is provided a refrigerator having a temperature controller including a control portion for setting a set temperature and a display portion for displaying the set temperature, wherein a secure hand being grasped by hands of users at time of opening and closing a door of the refrigerator protrudes from a side of the door more than the temperature controller does.

According to a fifth aspect of the present invention, there is provided a refrigerator comprising a plurality of chambers and a temperature controller having display portions corresponding to each of the chambers, and the display portion of the temperature controller is arranged in a formation in depth in an order similar to an arrangement of the chambers.

According to a sixth aspect of the present invention, there is provided a refrigerator comprising a temperature controller, wherein control portions of the temperature controller are arranged at a position where a display portions of the temperature controller are not hidden by a hand of a user operating the control portion.

According to a seventh aspect of the present invention, there is provided a refrigerator comprising a temperature controller having a function of setting a temperature inside. the refrigerator, located on a door of the refrigerator covering a front surface of the refrigerator, wherein the temperature controller comprises a control portion for setting a set temperature and a display portion for displaying the set temperature, and the display portion of the temperature controller, enabling to set a plurality of stages of the temperature, is enabled to display a plurality of types of temperature value and temperature range, and displays more than the number of the types.

According to an eighth aspect of the present invention, there is provided a refrigerator comprising a temperature controller, having a function of setting a temperature inside the refrigerator, located on a door of the refrigerator covering a front surface of the refrigerator, wherein the temperature controller comprises a control portion for setting a set temperature and a display portion for displaying the set temperature, a pointer for showing a state of temperature setting is formed in the display portion of the temperature controller, which can be set a plurality of stages of the temperature, and more than two pointers are used to set the temperature between adjacent pointers.

According to a ninth aspect of the present invention, there is provided a refrigerator comprising a cold heat tray having a cold heat accumulator storing a cold heat on a bottom surface of a casing accommodating foods in a quick freezing chamber, a cooling air exhaust port for supplying the cooling air into the casing, and a cooled air intake port for taking the cooling air in an upper portion of a front surface of the casing, wherein a compressor and a fan are run upon a command of the cooling operation.

According to a tenth aspect of the present invention, there is provided a refrigerator comprising a cold heat accumulator located on a lower surface of a casing for accommodating foods and so on in a quick freezing chamber, wherein a cooled air, introduced from a cooler, is subjected to forced convection between an upper portion of a back surface of the casing and an upper portion of a front surface of the casing.

According to an eleventh aspect of the present invention, there is provided a refrigerator comprising a temperature controller for setting a time for cooling to obtain a predetermined temperature, wherein an end of the time for cooling is informed after a lapse of the time.

According to a twelfth aspect of the present invention, there is provided a refrigerator comprising a plurality of chambers and a temperature controller having control portions respectively corresponding to the plurality of chambers, wherein the plurality of chambers are quickly cooled by an operation of the control portions.

According to a thirteenth aspect of the present invention, there is provided a refrigerator comprising a temperature controller having a control portion, wherein the control portion is separate from the refrigerator.

According to a fourteenth aspect of the present invention, there is provided a refrigerator comprising a temperature controller having a control portion for setting a set temperature in a preserving chamber of the refrigerator, and a temperature detecting means for detecting the temperature inside the preserving chamber, wherein when a detected temperature inside the preserving chamber from the temperature detecting means is higher than the set temperature, the preserving chamber is cooled; and when the detected temperature is lower than the set temperature, the preserving chamber is heated.

According to a fifteenth aspect of the present invention, there is provided a refrigerator comprising a preserving chamber, a temperature in which is set for soft freezing.

According to a sixteen aspect of the present invention, there is provided a refrigerator comprising a temperature controller having a control portion for setting a set temperature inside the refrigerator, wherein the temperature controller is controlled from an outside by a communication means, such as a telephone line, a lamp circuit, and radio.

According to a seventeenth aspect of the present invention, there is provided a method of operating a refrigerator comprising steps of: setting a temperature inside a preserving chamber, provided for quickly freezing, to be suitable for soft freezing, and quickly freezing the preserving chamber prepared to be a set temperature suitable for storing foods and so on, by a preset time.

According to an eighteenth aspect of the present invention, there is provided a method for operating a refrigerator comprising steps of: setting a temperature inside a preserving chamber; and blowing a cooling air into the preserving chamber or heating inside the preserving chamber based on whether or not a temperature of foods and so on, stored in the preserving chamber, is higher than a preset temperature.

According to a nineteenth aspect of the present invention, there is provided a method for operating a refrigerator, wherein a cooling air is blown into a preserving chamber, or the preserving chamber is heated by a cooling switch or a heating switch.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Detailed explanation will be given of preferred embodiments of the present invention in reference to FIGS. 1 through 9 as follows, wherein the same numerical references are used for the same or similar portions and description of these portions is omitted.

Figure 1:
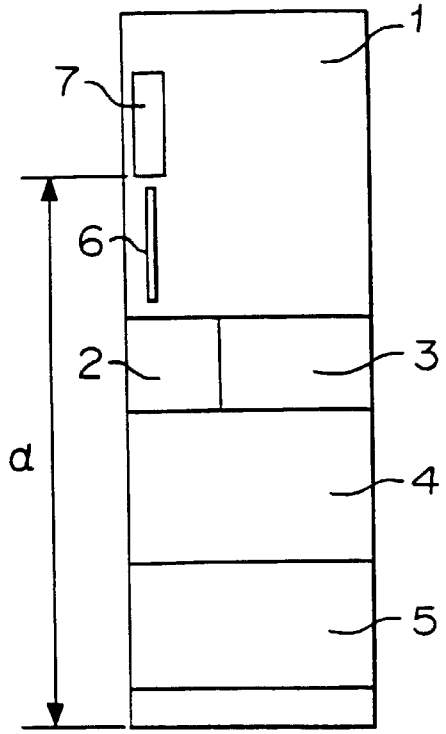
FIG. 1 is a front view of a refrigerator according to Embodiment 1 of the present invention.
Figure 2:
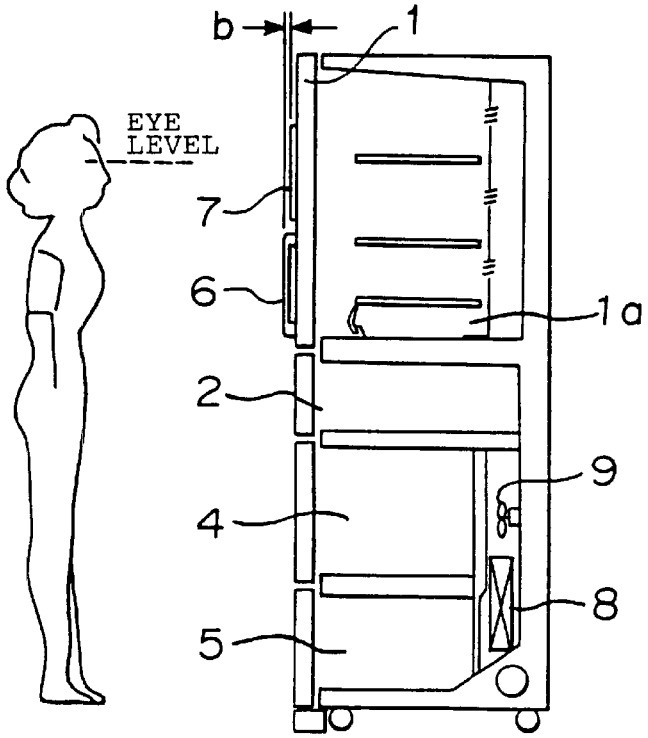
FIG. 2 is a cross-sectional view of the refrigerator according to Embodiment 1 of the present invention.

FIG. 1 is a front view of a refrigerator according to Embodiment 1 of the present invention. FIG. 2 is a cross-sectional view of FIG. 1. In the figures, numerical reference 1 designates a refrigerating chamber; numerical reference 1*a* designates a slide chamber located on a bottom surface of the refrigerating chamber 1; numerical reference 2 designates an ice chamber; numerical reference 3 designates a switching chamber which can be switched to a wine chamber, a vegetable and refrigerating chamber, a chilling chamber, a soft freezing chamber, a freezing chamber, and so on. Numerical reference 4 designates a vegetable chamber; numerical reference 5 designates a freezing chamber; numerical reference 6 designates a handle as a secure hand for grasping by a hand of user at time of opening a door of the refrigerator, which handle is located in the door; numerical reference 7 designates a temperature controller; numerical reference 8 designates a cooler; and numerical reference 9 designates a fan. The refrigerating chamber 1 is positioned in an uppermost stage, and the slide chamber 1*a* is positioned on the bottom surface of the refrigerating chamber 1. The ice chamber 2 and the switching chamber 3 are parallelly positioned in a lower portion of the refrigerating chamber 1. The vegetable chamber 4 is positioned therebelow. The freezing chamber 5 is positioned in a lowest stage. Temperatures inside these chambers are set through the temperature controller 7 positioned above the handle 6 outside the door of the refrigerator 1. It is possible to check current temperatures of these chambers and set times such that each of the chambers is quickly frozen or cooled for required minutes or required hours and from a required time to a required time. A compressor and a fan are controlled to be a set temperature based on the temperature inside the refrigerator.

Figure 9:
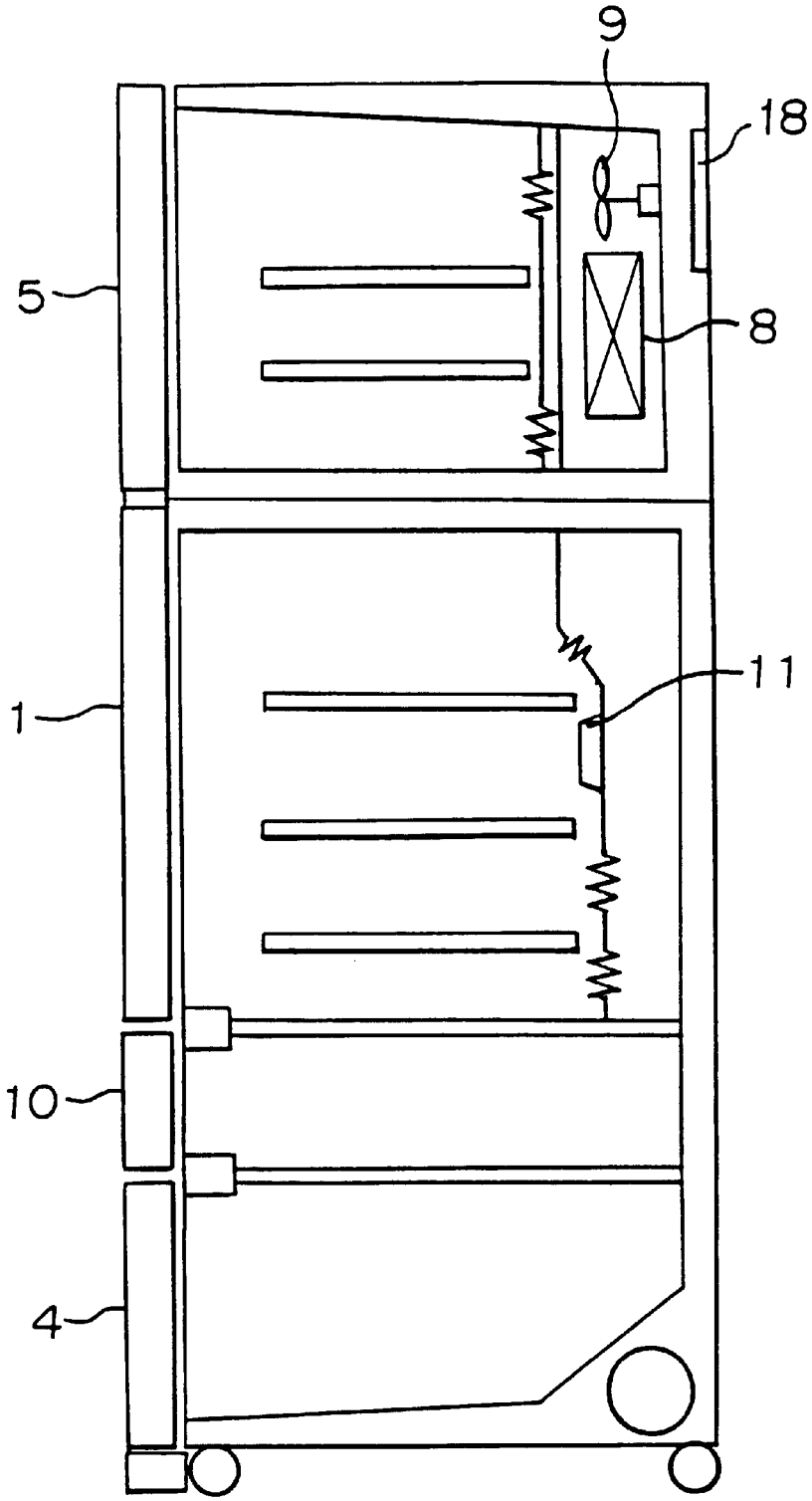
FIG. 9 is a cross-sectional view of the refrigerator according to Embodiment 1 of the present invention.
Figure 10:
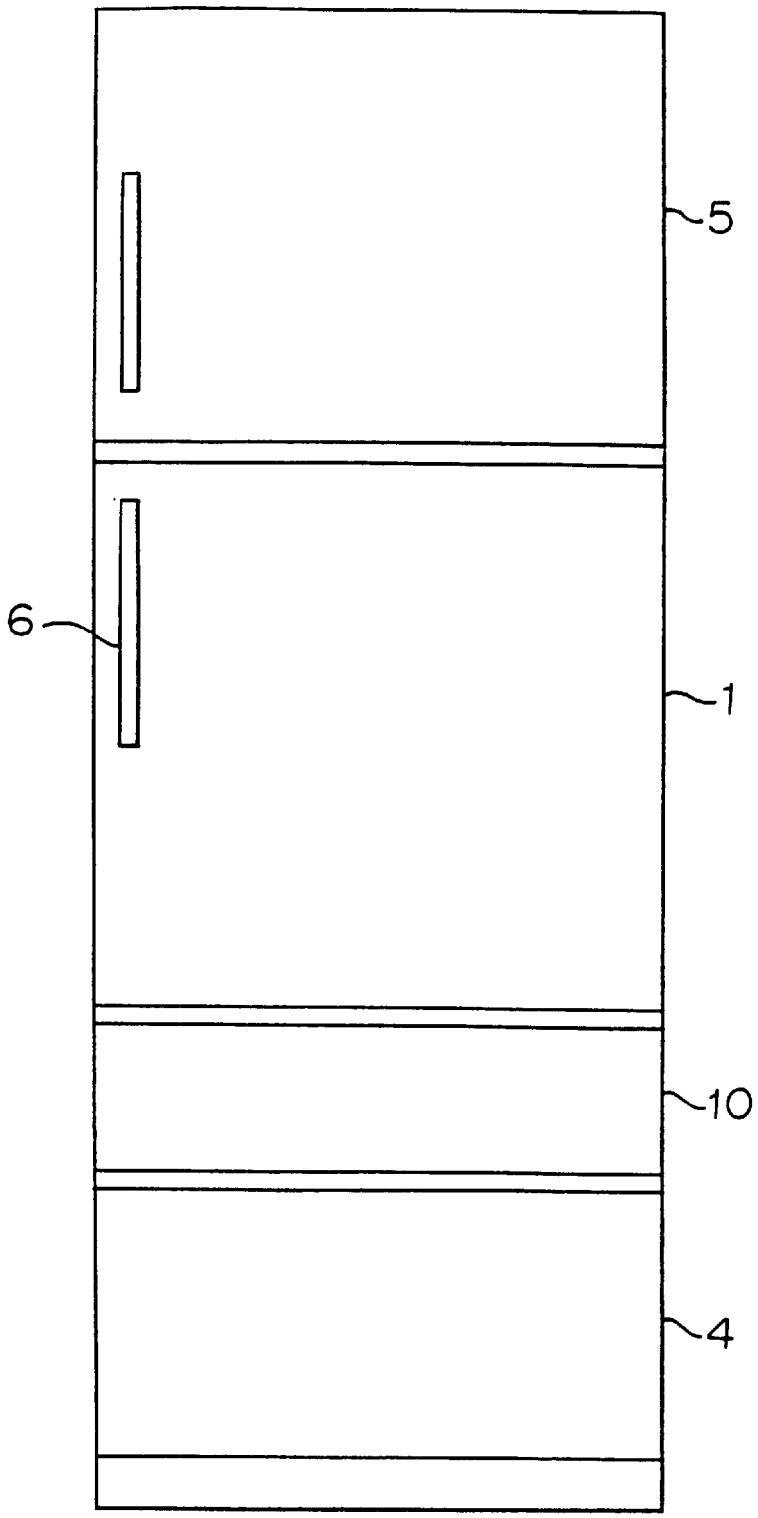
FIG. 10 is a front view of a conventional refrigerator.
Figure 11:
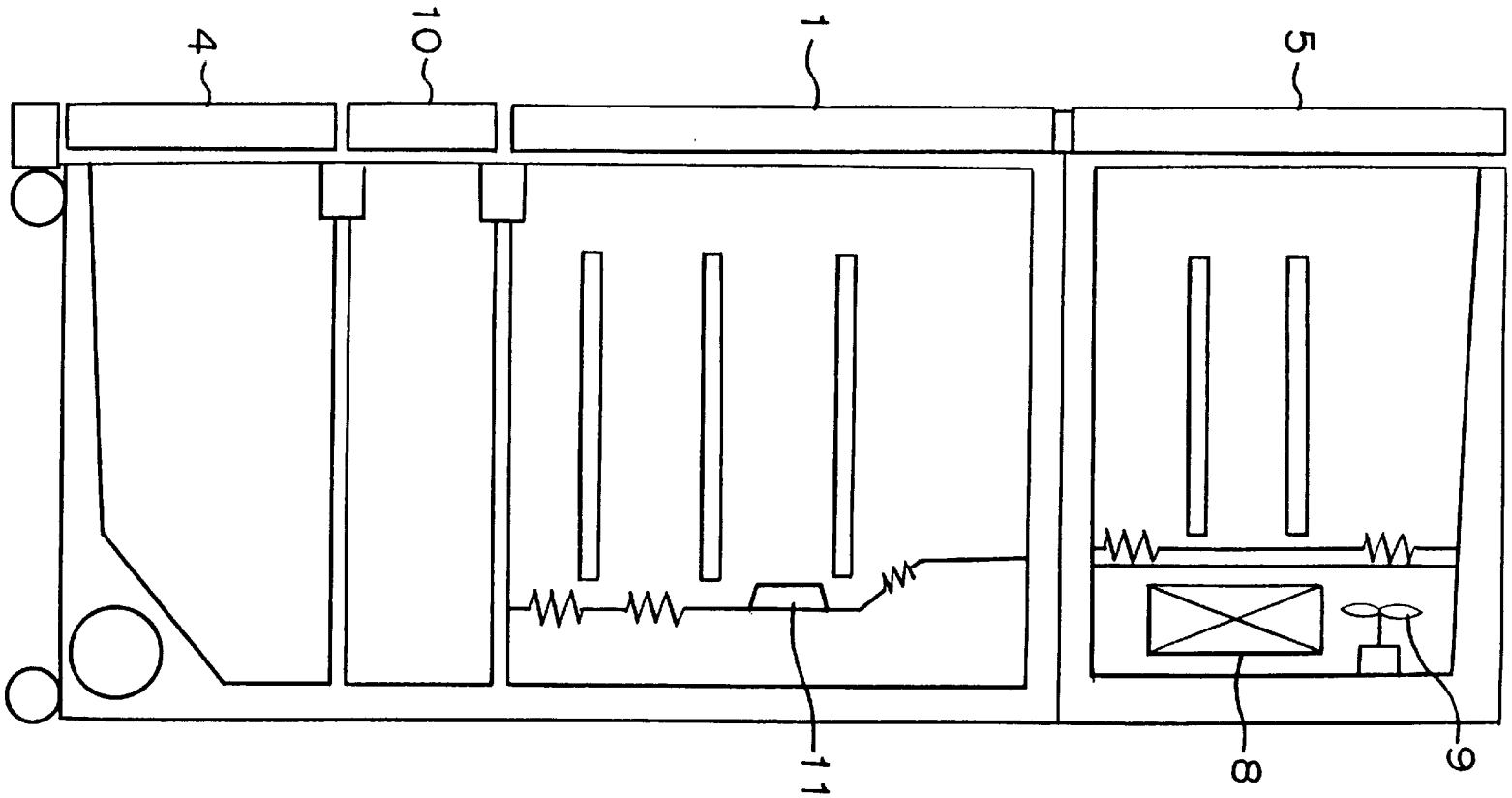
FIG. 11 is a cross-sectional view of the conventional refrigerator.
Figure 12:
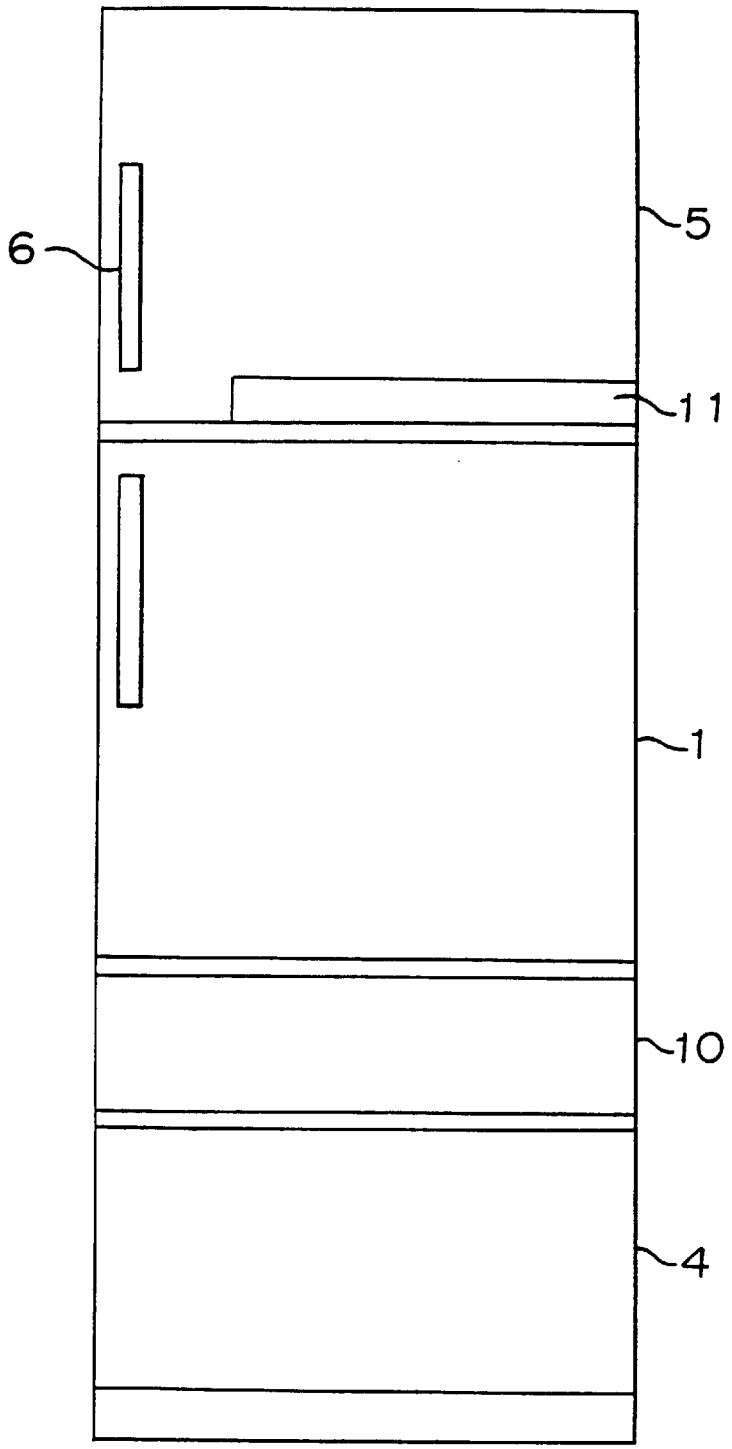
FIG. 12 is a front view of a conventional refrigerator.
Figure 13:
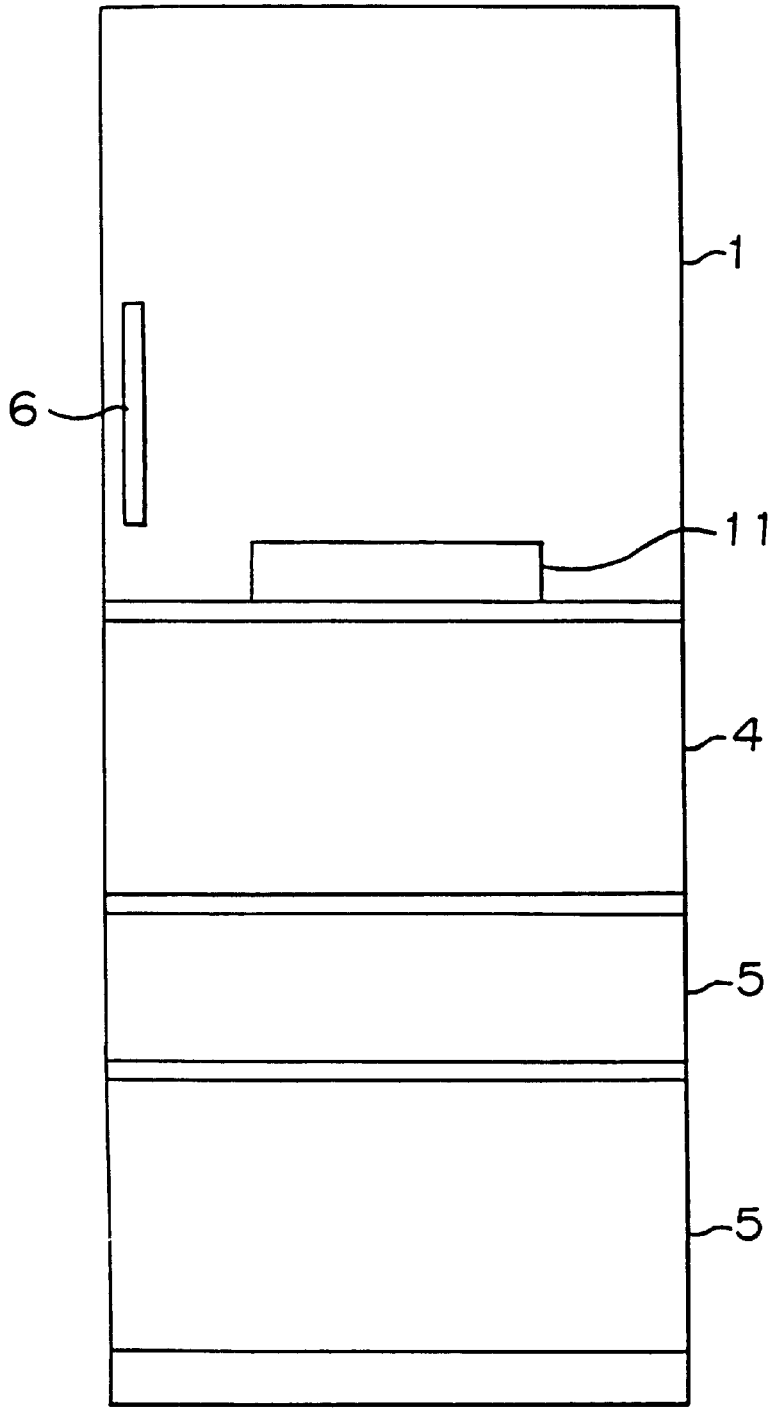
FIG. 13 is a front view of a conventional refrigerator.
Figure 14:
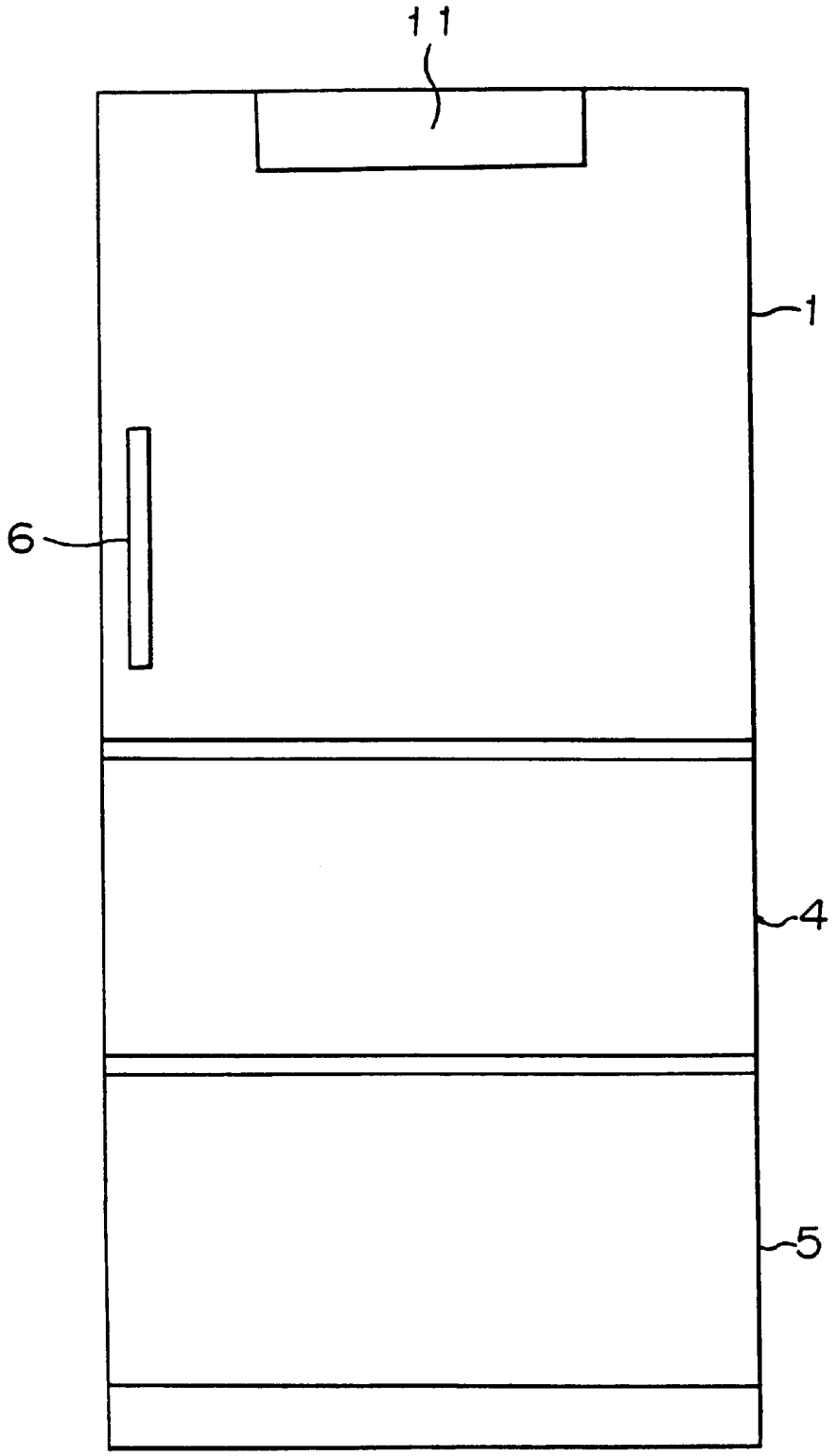
FIG. 14 is a front view of a conventional refrigerator.
Figure 15:
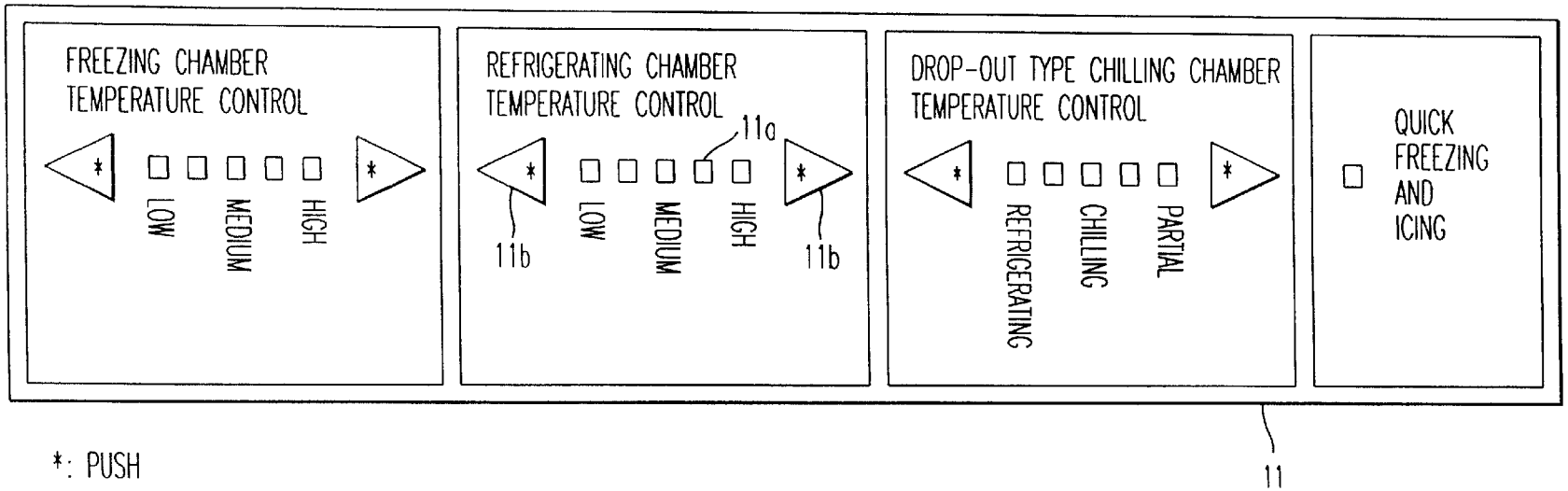
FIG. 15 is a detailed view of a temperature controller according to a conventional refrigerator.
Figure 16:
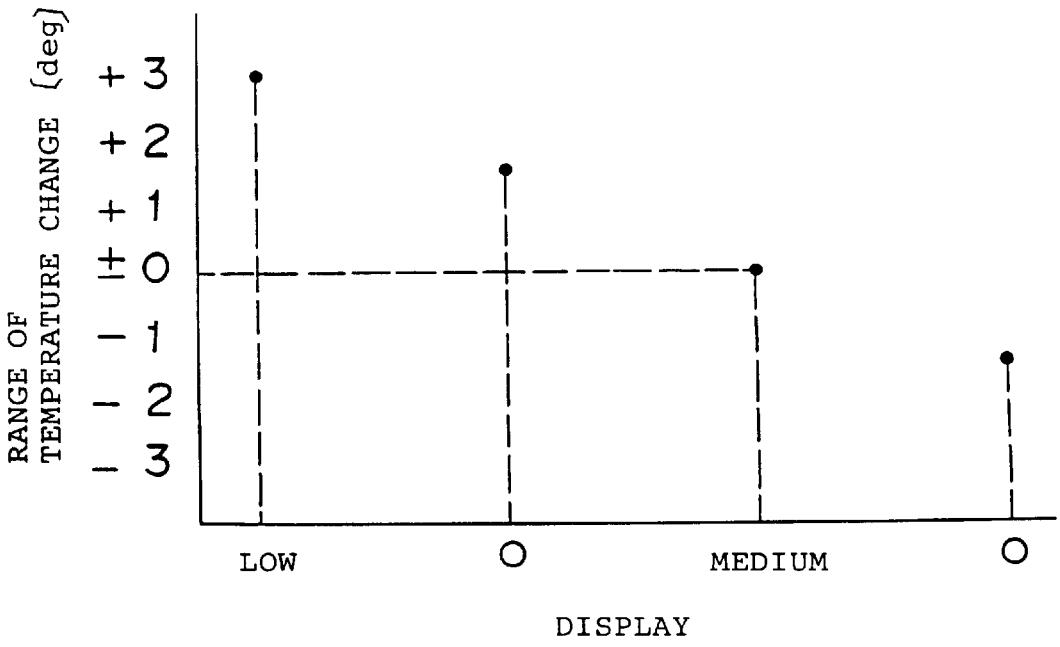
FIG. 16 illustrates a relationship between a display and a temperature setting according to the conventional refrigerator.

A control of setting the temperature for the compressor and the fan will be described. FIG. 9 is a cross-sectional view of the refrigerator. Description of numerical references same as those in FIG. 11 is omitted. When the refrigerator is quickly cooled after pushing "a switch for selecting chambers to be quickly cooled" in the control portion 7*b* of the temperature controller 7, a microcomputer on a substrate 18, located on a back surface portion in FIG. 9, makes the compressor run at a high rate and a fan inside the refrigerator also at a high rate to a send a large quantity of a cooled air for quickly cooling foods. In consideration of influences to already preserved foods, for example, an attention is paid to quickly cool the refrigerator while detecting a current temperature inside the refrigerating chamber so that the temperature inside the refrigerating chamber is no excessively decreased.

Positions of the temperature controller 7 and the handle 6 will be described. The temperature controller 7 is positioned in a height $\alpha$ of 130 cm or more in FIG. 1, in consideration of an average height of 127 cm of 8 years old children, based on a national nutritive investigation in year 1995, as a position where eye levels of children can not reach. The handle 6 protrudes by b of, for example, 1 mm, or more in a direction of a height of the temperature controller 7, wherein the temperature controller is positioned above the handle in FIG. 2.

The cooled air, cooled by the cooler 8 positioned on back surfaces of the vegetable chamber 4 and the freezing chamber 5, is sent to various chambers of the refrigerator and is controlled to cool the chambers to the temperature set in the temperature controller 7. When a user opens and closes the door of the refrigerator 7 through the handle 6, in case of a woman having a height of 158 cm, the display portion 7*a* located above the handle 6 is in alignment with an eye level of the woman. Therefore, it becomes easy to check the temperature inside the refrigerator and the temperature setting at every time of opening and closing the door by grasping the handle 6 by a hand of user.

Further, because the handle 6 protrudes more in comparison with the temperature controller 7, the handle 6 hits a wall and a furniture existing on a front side of the door at time of opening and closing the door, whereby it is possible to prevent breakage of a liquid crystal display portion 7*a* and an erroneous operation of the switch portion 7*b*. Namely, a completely different operation is not conducted even when the door hits the wall and the furniture to turn on a switch. The handle may be located along a total height of the refrigerating chamber 7 in a longitudinal direction of the refrigerating chamber 7.

Further, although the temperature controller 7 is located on a surface of the door in the uppermost stage, in this embodiment, it is not positioned in the uppermost portion. Therefore, an external pressure is seldom applied on an upper portion of the refrigerator at time of loading, whereby it is possible to prevent the temperature controller 7 including a precision instrument from being damaged. Such an external pressure is applied by a person getting on a ceiling of a package of the refrigerator in a stage of flowing this and/or piling other loads on the package, whereby the ceiling portion of the package is destroyed, and the refrigerator is pitted and/or scratched. Further, in case that an object is put on and off a refrigerator, there is a high possibility that an impact is applied to an uppermost portion. However, because the temperature controller 7 is positioned above the handle 6 of the door, it is possible to prevent the above breakage.

In FIG. 1, the temperature controller 7 is positioned on a side of the handle 6, i.e. left side, of the refrigerator. However, the temperature controller 7 may be located on an adverse side, i.e. right side, and in a central portion between the right and left sides, as long as the height of the handle 6 is in the vicinity of the eye level.

Figure 3:
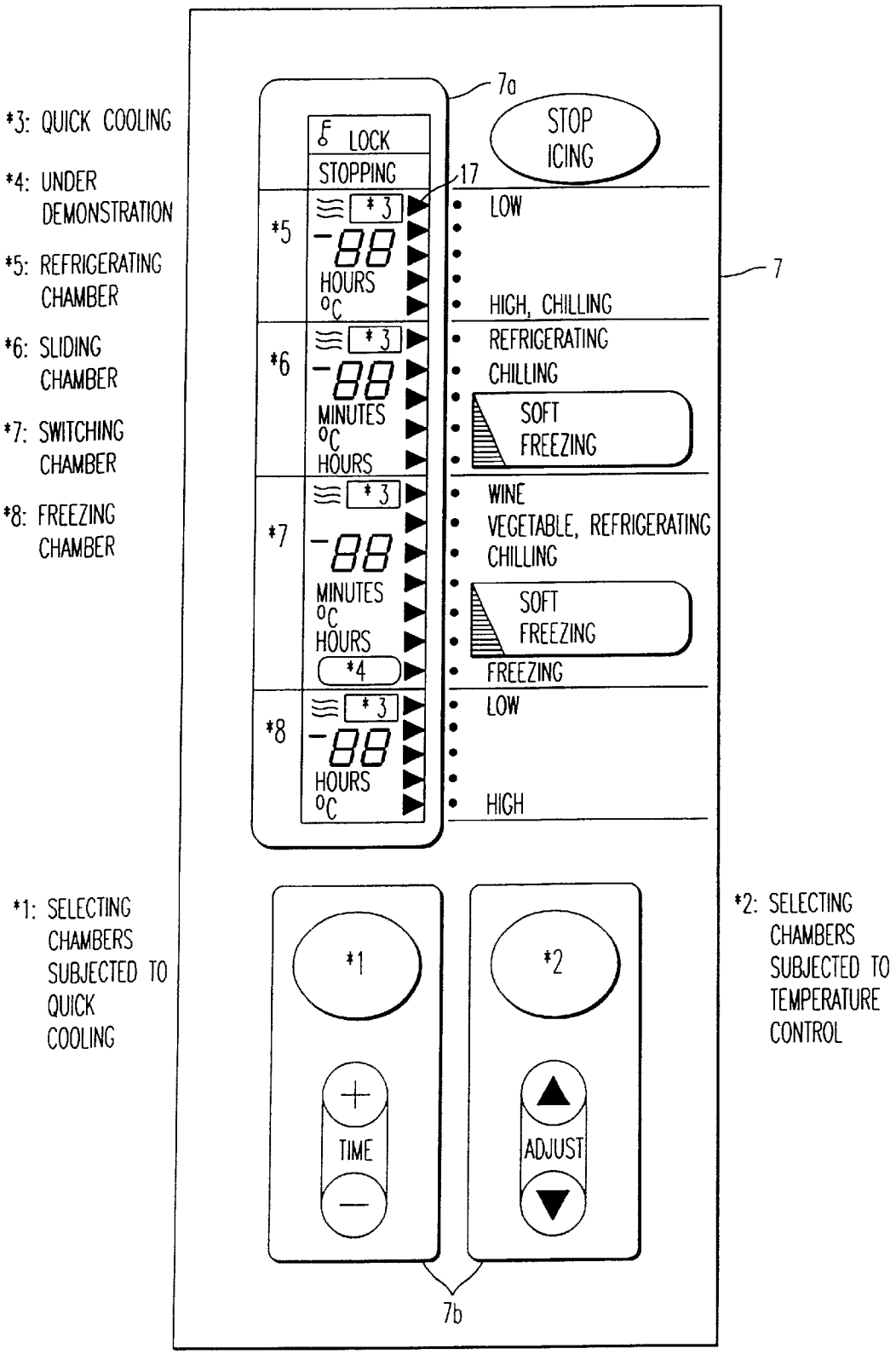
FIG. 3 is a detailed view of a temperature controller of the refrigerator according to Embodiment 1 of the present invention.
Figure 4:
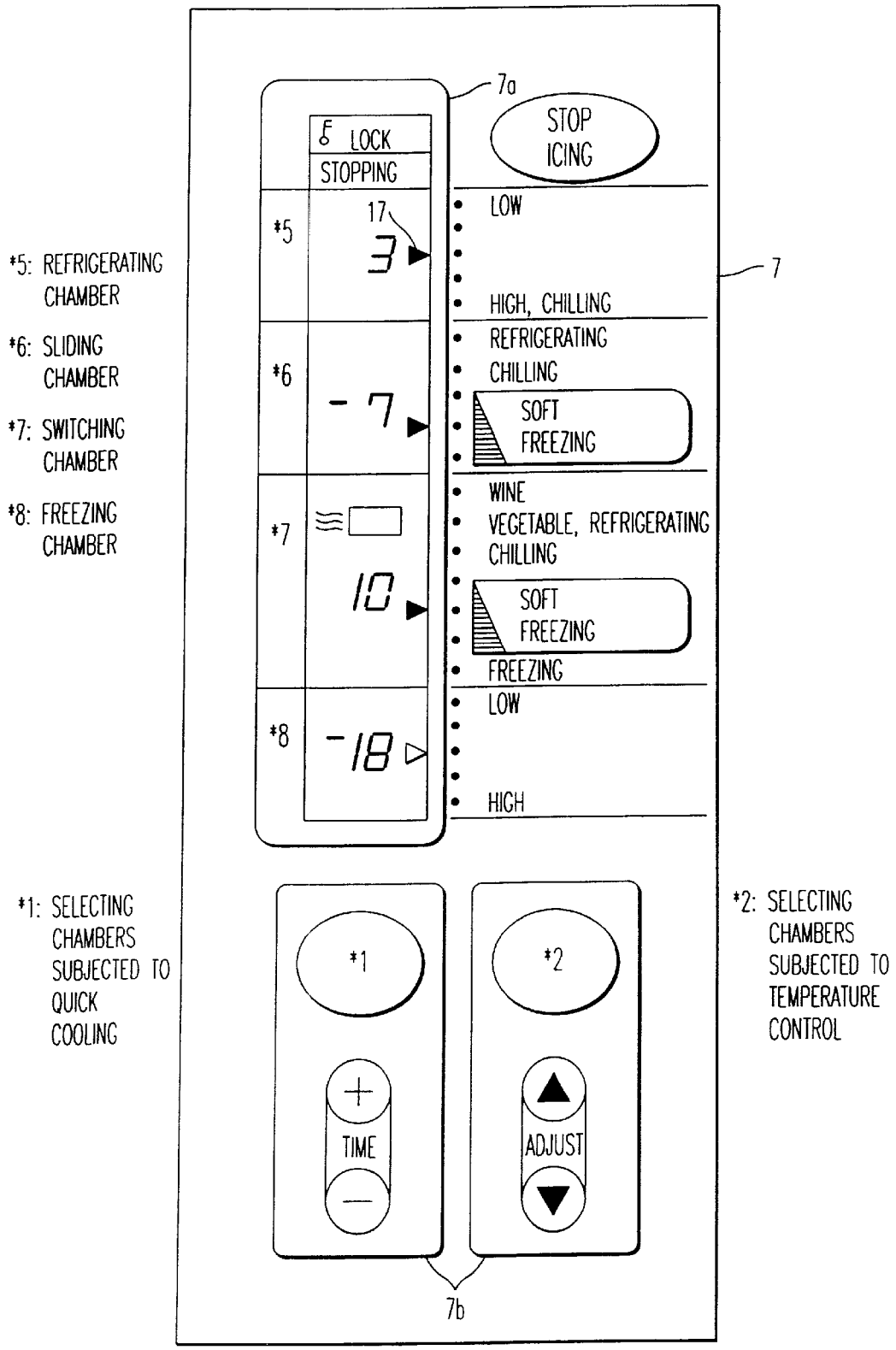
FIG. 4 is a detailed view of the temperature controller of the refrigerator according to Embodiment 1 of the present invention.

FIGS. 3 and 4 illustrates details of the temperature controller 7. The temperature controller 7 includes the liquid crystal display portion 7*a* for showing states of the temperatures inside various chambers, the switch portion 7*b* including a button for selecting a chamber subjected to a temperature control and "a button for controlling the temperature inside the selected chamber" having prints of upward and downward arrows, shown in the right bottom of FIG. 3, and the switch portion 7*b* having "a button for selecting a chamber subjected to quick cooling" and a button for selecting a time of quick cooling for the selected chamber having prints of +−, shown in the left bottom of FIG. 3.

FIG. 3 illustrates the entire liquid crystal display portion 7*a*. FIG. 4 illustrates a state that the refrigerating chamber 1 is in a medium mode between a low mode and a high mode, designated by a black dot; the slid e chamber 1*a* is in a soft freezing mode; the switching chamber 3 is in a soft freezing mode; and the freezing chamber is in a medium mode, i.e. temperature range, between a low mode and a high mode, designated by a black dot, and current temperatures of the refrigerating chamber 1, the sliding chamber 1*a*, and the freezing chamber 5 are respectively 3° C., −7° C., and −18° C. The switching chamber 3 is set t o quickly cool for ten minutes.

Displays of the chambers are arranged in the order of the refrigerating chamber, the sliding chamber, the switching chamber, and the freezing chamber from up to down, in a similar manner to the arrangement of the chambers in the refrigerator so that chambers subjected to the temperature setting and the quick cooling, and the actual arrangement of the chambers can be easily distinguished. Accordingly, erroneous operations can be reduced. The control portion is operated by pushing parts having prints of select chamber subjected to temperature control and select chamber subjected to quick cooling. The control portion is in a plane the same as those of the temperature display portion and the display portion for the selected chamber, whereby a possibility of erroneously pushing a switch is further reduced.

Further, the switch portion 7*b* is positioned below the liquid crystal display portion 7*a* so that the liquid crystal display portion 7 is not hidden by a hand of a user at time of controlling the switch. Therefore, it is possible to control while checking the display. The user operates a chamber subjected to quick cooling through the switch portion 7*b*, i.e. the switch for selecting the chamber subjected to quick cooling or a chamber subjected to temperature control through the switch for selecting the chamber subjected to temperature control, and thereafter the time switch or the adjusting switch is set. Although, it is possible to quickly cool all of the chambers, it is possible set through the microcomputer without setting the freezing chamber. In such a case, a display of quick freezing does not appear for the freezing chamber.

Figure 5A:
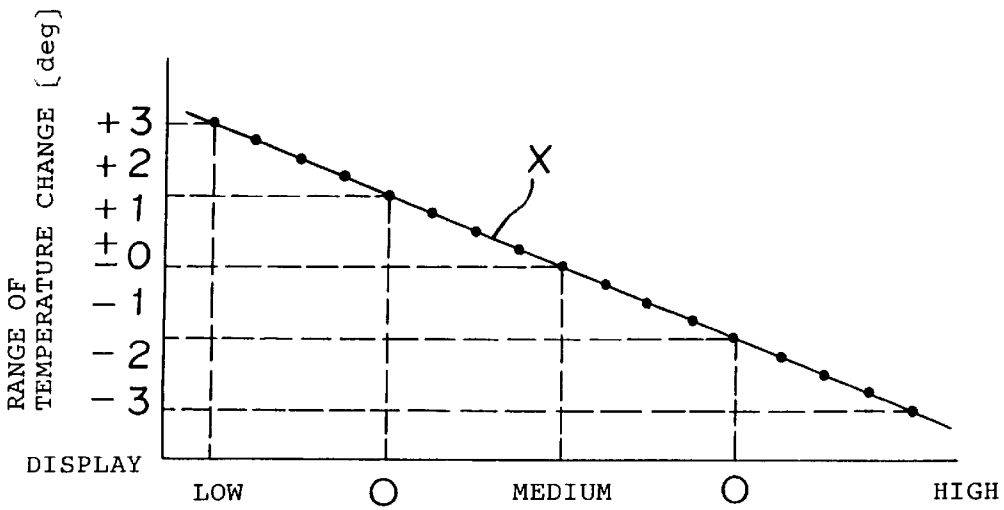
FIGS. 5*a* and 5*b* are a view for illustrating a relationship between a display of the refrigerator and a temperature setting according to Embodiment 1 of the present invention.

FIG. 5*a* illustrates a graph having a abscissa representing the display of the temperature, set in the temperature controller, and an ordinate representing the range of change [deg] with respect to the medium mode of the set temperature. The range of change in the low mode is +3[deg], wherein the temperature is increased from a standard temperature in the medium mode by 3[deg] when the low mode is set. Similarly, a range of change in the high mode is −3[deg], wherein the temperature is decreased from the standard temperature by 3[deg]. Because the range of change in a middle between the low mode and the medium mode is +1.5[deg], the temperature is increased by 1.5[deg]. Because a range of change between the high mode and the medium mode is −1.5[deg], it is commanded to a temperature controlling board and so on to decrease the temperature by 1.5[deg]. Thus the temperature control is performed using the ranges of change with respect to a standard state, i.e. the medium mode. Although the ranges of change with respect to the displays of low, low-medium, medium, medium-high, and high have been described, in order to control by a further minute range of the temperature, the temperature is controlled using a range of change of the temperature with respect to the displays in use of a line X, shown in FIG. 5*a*. Seventeen points, plotted on FIG. 5*a*, correspond to three stages of the temperature ranges between adjacent modes of the five modes of low, low-medium, medium, medium-high, and high. Accordingly, the range of change between adjacent points of the seventeen points is about 0.38[deg], whereby the temperature can be minutely set, if necessary, and it becomes possible to control the temperature with a high accuracy.

Figure 5B:
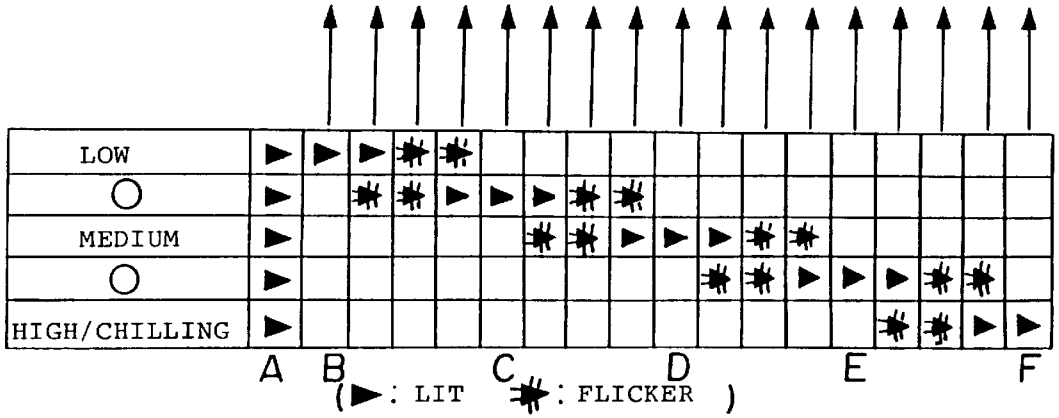

When the five modes of low, low-medium, medium, medium-high, and high are displayed in the display portion of a control panel to make it possible to set five temperature ranges, the pointers 17 in the display portion 7*a*, corresponding to FIGS. 3 and 4, are illustrated in FIG. 5*b*. Each box in a longitudinal direction in FIG. 5*b* corresponds to a single display portion, for example, the indication of the freezing chamber in the display portion 7*a* in FIG. 4. Laterally directed triangle marks correspond to pointers showing the set temperature range. In a column A, five pointers are lit. However, the five pointers practically do not lit at a same time. This state is illustrated only as an example that all of the pointers are fully displayed as in FIG. 3. A column B illustrates a state of the pointers, displayed when the temperature is set to be low. The triangle pointer is lit at a position corresponding to an indication of low. A column C corresponds to a state of the pointers, displayed at time of setting the temperature of low-medium. The triangle pointer is lit at a position indicated by ○ between low and medium. Similarly, a column D corresponds to a case that the medium temperature is set. A column E corresponds to a case that the medium-high temperature is set. A column F corresponds to a case that the temperature of high is set. As described, a method of displaying the display portion of the control panel is described for the case that the five temperature ranges can be set.

Next, it is necessary to minutely set the temperature as the temperature control to be more than five temperature ranges. An example necessitating an accuracy will be described in use of FIG. 5*b* in connection with the display in a display portion 7*a* of the control panel 7 in case of setting the seventeen temperature ranges in FIG. 5*a*. All loads other than the column A are displayed. The column B corresponds to the set temperature of low, wherein the pointer lit at a position indicated as low. In a column one stage of the temperature higher than the column B, the lit mark is positioned at low, and a blinking mark is displayed at the ○ mark between low and medium. In a column two stages higher than the column B, i.e. two stages lower than the column C, blinking marks are respectively indicated as positions corresponding to a row having an indication of low and the ○ mark. In a column three stages higher than the column B, i.e. one stage lower than the column C, a blinking mark is indicated at the row of the low, and a lit mark is indicated at the ○ mark. In the column C, the lit mark is indicated at the ○ mark between rows having indications of low and medium. In a column one stage higher than the column C, the lit mark is indicated at the ○ mark, and a blinking mark is indicated at the row of the medium. In a column two stages higher than the column C, blinking marks are respectively indicated at the ○ mark and the row of the medium. In a column three stages higher than the column C, the blinking mark is indicated at the mark ○, and the lit mark is indicated at the row of the medium. In the column D, the lit mark is indicated at the row of the medium. In a manner similar thereto, the following columns to the column F are indicated. As described, by combining the lit marks and the blinking marks to display, the temperature setting of the seventeen stages is attained using the five pointers. As described, the one lit mark and the one blinking mark are used for positions preceding and following by one stage from the display of five stages, and the two blinking marks are used for positions preceding and following by two stages from the display of the five stages, whereby the minute display becomes possible. However, these combinations of the lit marks and the blinking marks are one of examples. Therefore, it is possible to display using other indicators, other marks, and so on. Accordingly, it becomes possible to set plural types of temperature differences. Further, more than the number of pointers indications of the temperature becomes possible using less number of the pointers. Accordingly, further minute temperature setting and temperature control becomes possible. Further, by changing the display of the pointers, large temperature differences through small temperature differences can be easily set.

In an ordinary setting, only lit pointers are used as in FIG. 5*b*. In case the minute temperature setting becomes necessary, for example, foods to be easily frozen, such as tofu, are accommodated, minute temperatures can be set.

In the display portion 7*a* in FIG. 4, the temperature range of the refrigerating chamber is in the standard mode, i.e. the medium mode in a center between the low mode and the high mode, wherein a value of the temperature is 3° C. This corresponds to the column F in FIG. 5*b*, in which the high and chilling temperature=(the standard temperature 3° C.)+(the range of change of the temperature −3[dec])=0° C. Although, in FIG. 4, the refrigerating chamber, the freezing chamber, the slide chamber, and the switching chamber is illustrated, when the vegetable chamber and the chilling chamber are independent chambers, it is preferable to set a standard temperature of the vegetable chamber about 5° C. and a standard temperature of the chilling chamber about 0° C.

In FIG. 5*b*, rows longitudinally arranged in the order of low, ○, medium, ○, and high/chilling. In case of the freezing chamber, a portion of high/chilling is sufficient to change to high; and in case of other chambers having other temperature ranges, these indications may be changed in conformity with their uses.

Although the switching chamber 3 is set to quickly cool by ten minutes in FIG. 4, when it is required to make a salad and so on by boiling vegetables, nutrients are lost from the vegetables and the salad becomes waterish because the vegetables including water is quickly cooled. However, when the vegetables are left under an ordinary temperature to avoid these problems, an after heat proceeds the boiling more; feel in a mouth is spoiled; a color is degraded; and the nutrients are decomposed by the after heat. Thus, in case of the cooling by water and the leaving under the ordinary temperature, there are problems in terms of the nutrients and taste.

When the switching chamber 3 is quickly cooled, because the soft freezing is especially set to be about −7° C., vegetables and so on are quickly cooled because moisture contained in the vegetables and so on are not quickly frozen, and there is no problem such as freezing and so on. Further, it is possible to quickly cool inside the freezing chamber 5. However because the setting of the temperature is about −18° C., the vegetables and so on may possibly be frozen. Further, because it is possible to set a time of quickly freezing through the temperature controller 7, it is possible to prevent foods from being frozen. In case that the foods are apt to be frozen, ten minutes are set as exemplified, a display device notifies a user by a sound, such as an alarm, after a lapse of the ten minutes quick cooling. Therefore, the cooling is not excessively performed. Although the alarm is described for notifying a termination of a cooking by quick cooling, it is also possible to sign for completions of ordinary refrigerating and freezing functions other than the quick cooling. When signs are emitted for a plurality of chambers, a type of the signs such as a tone and the length of the sound may be changed.

An example of a procedure of a method of quickly freezing or cooling the boiled vegetables will be described.

As a preliminary preparation for the quick cooling, a chamber to be quickly cooled, for example, the switching chamber 3 is cooled in the range of the soft freezing temperature. At first, the switch for selecting chamber subjected to temperature control is pushed to select the switching chamber 3. Thereafter, the switch for adjusting is pushed to select the soft freezing mode. When the switching chamber 3 becomes the soft freezing temperature, wherein it is unnecessary to preliminarily prepare if the switching chamber 3 has the soft freezing temperature. A next operation is performed. The boiled vegetables are put in the switching chamber 3. Then the switch for selecting chamber, subjected to quick cooling in a control portion 7*b* of the temperature controller 7, is pushed to change the display of the quick cooling to the switching chamber 3. The switch of time (+−) is pushed to display 10 minutes. After ten minutes, the quick cooling is completed. Then the sound alerts the completion of the quick cooling.

In use of the quick freezing function, it is possible to cool the boiled vegetables without missing the nutrient of the vegetables within a time shorter than that for cooling the boiled vegetables at an ordinary temperature.

Although the switching chamber 3 is set to be the soft freezing temperature range to quickly cooling this, a temperature range other than the soft freezing temperature range may be chosen, especially in case of the soft freezing temperature range. Especially, in case of the soft freezing temperature range, there are advantages that the cooling becomes quicker than that by the refrigerating chamber, the vegetables are not frozen unlike the cooling by the freezing chamber even though a user forgot to stop the cooling, and a power of the cooling is in a level of the freezing.

Decrements of the nutrients from the case of cooling inside the refrigerator by the cooled air to a case of cooling by a water or reviving under the ordinary temperature are ⅘ of vitamin C and ⅓ of inorganic ingredients. Further, when the cooling time is 10 minutes, by reducing the cooling time after heating, the decrement of vitamin C is restricted to ½ in 30 minutes and ⅓ in 60 minutes.

In most cases, a kitchen timer is equipped in a kitchen. However, the kitchen timer is frequency used, for example, for counting a boiling time. Therefore, if it is possible to set the quick cooling time exclusively for a refrigerator, the quick cooling function of the refrigerator is easily used, whereby a labor hour for housekeeping can be shortened. However, an effect similar to described above is obtainable by the quick cooling function to about −7° C. in use of an ordinary kitchen timer.

Incidentally, in case of setting to quickly cool, it may be informed that the preparation in the freezer for receiving foods at the soft freezing temperature after automatically quickly cooling and switching to the soft freezing temperature. For example, the preparation may be informed by displaying in the display portion 7*a* of the control panel 7, and by sounding. The preparation is completed when a set temperature is obtained. When a door is closed after putting the foods and so on into the preserving chamber, an operation of starting to count the quick freezing time is conducted. Accordingly, it is possible to cool with less change in tastes and less drop of the nutrients is automatically performed.

Further, the above-mentioned soft freezing at about −7° C. is used, an ice cream, which is difficult to make in the conventional freezing chamber 5, can be easily made. Conventionally, it is necessary to taking a mixture of a dairy cream, sugar, eggs, and so on out of the freezing chamber by several times and whipping these. However, in the present invention, it becomes unnecessary to take an ice cream out of the freezing chamber, i.e. the soft freezing chamber, having a bit high temperature of about −7° C., whereby a job becomes easy. For example, when as much as 200 cc dairy cream is whipped for about 8 minutes, as much as 200 g syrup, commercially available, is put into the dairy cream, the dairy cream and the syrup are lightly mixed, and thus obtained mixture is quickly cooled by about 3 hours, an ice cream of a certain type is made. Thus, by cooking to freeze at the soft freezing temperature in use of the quick freezing function, an ice cream can be made with less job and quicker than usual. Although it is necessary to whip in use of the conventional refrigerator, because a fat in the dairy cream is not frozen at about −7° C., smoothness of the ice cream is maintained. Further, gustation of human kinds become sensitive as a temperature is high, an ice cream, made with the soft freezing of about −7° C., makes a human feel much sweetness in comparison with an ice cream, made at a temperature of −18° C. even though the amount of sugar is reduced, whereby the amount of sugar can be reduced, and it is beneficial in health.

Heretofore, the example of setting the recipe and the cooling temperature range has been described so that a desert such as an ice cream becomes soft without a device for whipping and a whipping operation in use of the refrigerator, a conservative food is deliciously cooked from a state that a fat is not frozen.

Needless to say that a healthy home made ice cream is easily made. Further, there is an advantage that a delicious desert is made at a low cost as a business because a sugar and so on can be reduced.

Figure 6:
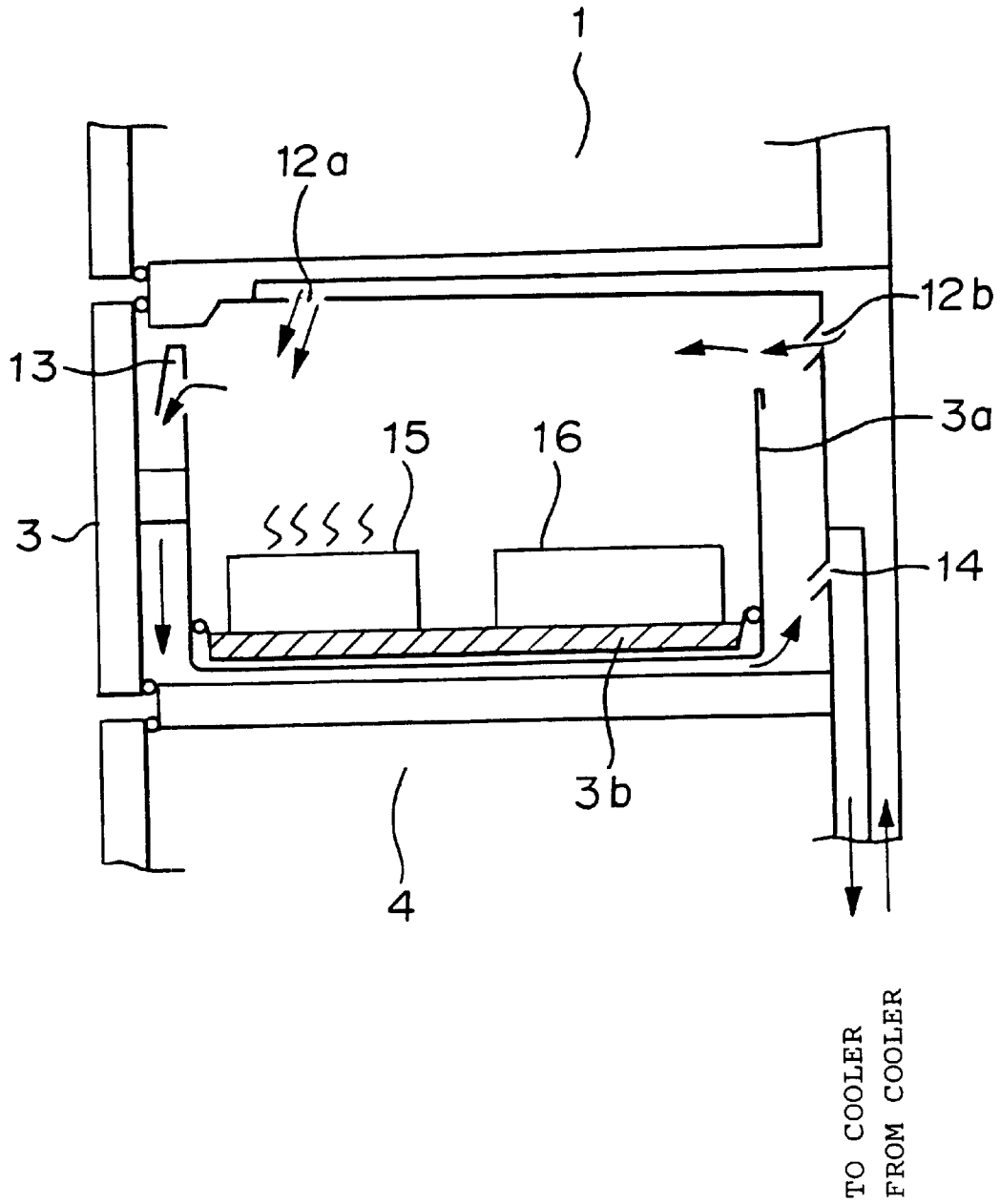
FIG. 6 is a cross-sectional view of a switching chamber of the refrigerator according to Embodiment 1 of the present invention.

FIG. 6 illustrates a cross-sectional view of the switching chamber in FIG. 1. In FIG. 6, numerical reference 1 designates the refrigerating chamber; numerical reference 3 designates the switching chamber; numerical reference 3*a* designates a case for storing a food, the case is equipped in the switching chamber; numerical reference 3*b* designates a cold heat storage tray, located on a bottom surface of the switching chamber 3; numerical reference 4 designates the vegetable chamber; numerical reference 12 designates an exhaust port, formed on an upper portion of a back surface of the switching chamber 3; numerical reference 13 designates an intake port formed in the case 3*a*; numerical reference 14 designates an intake port, formed on a lower portion of the back surface of the switching chamber 3; numerical reference 15 designates a warm food newly stored in a switching chamber 3; and numerical reference 16 designates a cooled food previously stored in the switching chamber 3.

Inside the switching chamber 3, the case 3*a* is installed. The heat storage tray 3*b* is installed in the case 3*a*. On the back surface and a ceiling portion, the exhaust ports 12*b* and 12*a* for the cool air, cooled by the cooler 8 and sent by the fan 9, are located. The cool air cools the case 3*a*, is discharged out of the case from the intake port 13 on a front surface portion of the case 3*a*, and returns to the cooler from the intake port 14 on the lower portion of the back surface of the switching chamber. Although the two exhaust ports 12 are located, the number of the exhaust ports may be one or three or more. Further, the two exhaust ports may be located on the ceiling portion.

The food 16 is previously stored in the switching chamber 3, and the food 15 is the warm food. In a conventional technique, warm foods are not immediately stored in a refrigerator because a temperature inside the refrigerator is increased and temperatures of previously stored foods 16 are increased. However, in case that cooked rice and so on are left, it is possible to clear a table if the cooked rice can be stored in the refrigerator in a warm state. When it is necessary to leave the cooked rice until it is cooled to a certain extent, it is sometimes forgotten to put it away or such a work makes a person nervous. If the person wish to go out, it is necessary to keep a sufficient time before going out.

By using the quick freezing function, it becomes possible to cool the warm rice to a temperature suitable for keeping the rice within a time shorter than that in case of cooling the warm rice at an ordinary temperature without spoiling a food value, such as a starch, by a heat of the warm rice. Further, by using the heat storage tray 3*b*, the food value is maintained, and the cooling time can be reduced.

Meanwhile, by using the quick freezing function for cooling to store a meat, a fish and so on, although food values of these are not spoiled by their heats unlike the warm rice, a drop of the food values can be prevented by quickly cooling, namely by, in this case, making temperatures of the meat, the fish and so on pass through a maximum ice crystal temperature range.

However, in FIG. 6 illustrating this embodiment, when the warm food 15 is stored and the switching chamber 3 is set to quickly cool by the temperature controller 7, a cooled air is sent from the exhaust port 12 so as to quickly cool the food 15 from an upper portion of the food 15, whereby the food is directly cooled by a directly cooling function of the heat storage tray 3*b*. In this case, a setting time for the quick cooling is preferably 1 through 2 hours because the warm food is stored. Depending on the seasons, for example in summer, the setting time is 3 hours. Requisite times are set to quickly cool foods based on the seasons, temperatures of the foods, a quantity of storage, final cooling temperature, types of the foods, and so on. These requisite times may be memorized in a microcomputer of the refrigerator.

In order to promote the quick cooling, the exhaust port 12*a* is located on the ceiling portion of the preserving chamber 3, the exhaust port 12*b* is located in the back surface portion of the preserving chamber 3, and the exhaust port 12*b* is located in the back surface portion of the preserving chamber 3 to supply the cooled air into an entire inside of the preserving chamber 3. Hereinbelow, a case that a warm food is stored in the preserving chamber on a side of the door and started to quickly cook this is described with respect to a cooled air circulation. The food is mainly cooled by the cooled air from the exhaust port 12*a*, located inside the preserving chamber on the door side, and a warm air, emitted from the warm food, is immediately sucked from the intake port 13 located inside the preserving chamber on the door side and send outside the preserving chamber. Therefore, the previously stored food is seldom suffered from an influence of the warm food. Even though the food stored in a depth of the refrigerator is high and the exhaust port 12*b* located in the back surface portion is clogged, the cooling air is sufficiently supplied from the exhaust port 12*a* in the ceiling portion.

The heat storage tray 3*b* will be described. Although the heat storage tray 3*b* is illustrated by a hatched portion. An outer shell is formed around the hatched portion, the outer shell is constructed by a tray made of, for example, aluminum. The thickness of the heat storage agent is several mm or more, for example about 5 mm. A metal having a heat capacity the same as the heat storage agent, such as aluminum and stainless, may be used instead of the heat storage agent. Because the thickness of a conventional tray is about 0.5 mm, heat is conducted but heat is not stored. This heat storage agent has a function of taking a given heat away and store the heat.

By the heat storage agent 3*b*, when the warm food 15 is stored in the refrigerator 3, the heat of the warm food 15 is taken away by the heat storage agent 3*b* to thereby prevent an exchange of heat between the warm food and the cold food 16, previously stored.

By pushing a quick cooling button, the compressor and the fan are operated with large capabilities to quickly cool the refrigerator.

By setting the quick cooling, because the cooled air is sent to the switching chamber 3 along with a storage of a food, a warm air around the food 15 heated by the food 15 is immediately returned to the cooler 8 through the intake port 13, whereby temperatures of the switching chamber 3 and the food 16 are prevented from increasing. Therefore, even warm foods can be immediately stored in the refrigerator with a relief and without affecting the other foods in the refrigerator, whereby a labor time for house holding can be reduced, and there is an effect in an aspect of nutrients as described above.

In cases that the quick cooling is promoted, and a food having a high temperature and so on are stored, an aluminum tray containing the heat storage agent, and the air is forcibly convected inside the cooling chamber, and the cooled air intake port is arranged at a position closer to the exhaust port than a portion for storing the foods. The quick cooling time is set to quickly cool to the set temperature at time of storing the foods, whereby it is possible to quickly cool the foods. Further, by locating the tray in the chamber set to be a soft freezing temperature, the temperature of the foods is not extremely lowered to assure a safety of a person even though his hand touches the foods.

Although the heat storage tray 3*b* for directly cooling is located on an entire surface of a floor of the case 3*a*, this is a space for easily storing the warm foods. For example, the heat storage tray 3*b* may be located on a side closer to the case 3*b*, or the heat storage tray 3*b* may be movable inside the case 3*a* to move to a requisite portion to use.

Although the quickly cooling function is positioned inside the case 3*a* of the switching chamber 3, an independent quick cooling chamber may be formed as a single chamber. The quick cooling chamber is wieldy if a size and a height sufficiently accommodating a pot and a dish being large to some extent are fully received.

Further, by forming a chamber having dual functions of cooling and heating, it becomes possible to inform a user a completion of quick cooling or heating cooking by detecting a temperature of the food by an infrared ray sensor, comparing with a set temperature, automatically selecting whether the food is quickly cooked or quickly heated, and sounding a sound generator such as a buzzer when the food becomes a desirable temperature, in case that the desirable temperature is set by the user in a temperature controller 7. Meanwhile, the refrigerator may be a machine for this exclusive use having these functions.

In the convention technique, the user hesitates to select chambers having different temperatures, in which a food is stored. According to the present invention, it becomes possible to freely cool or heat by setting a single desirable temperature.

Figure 7:
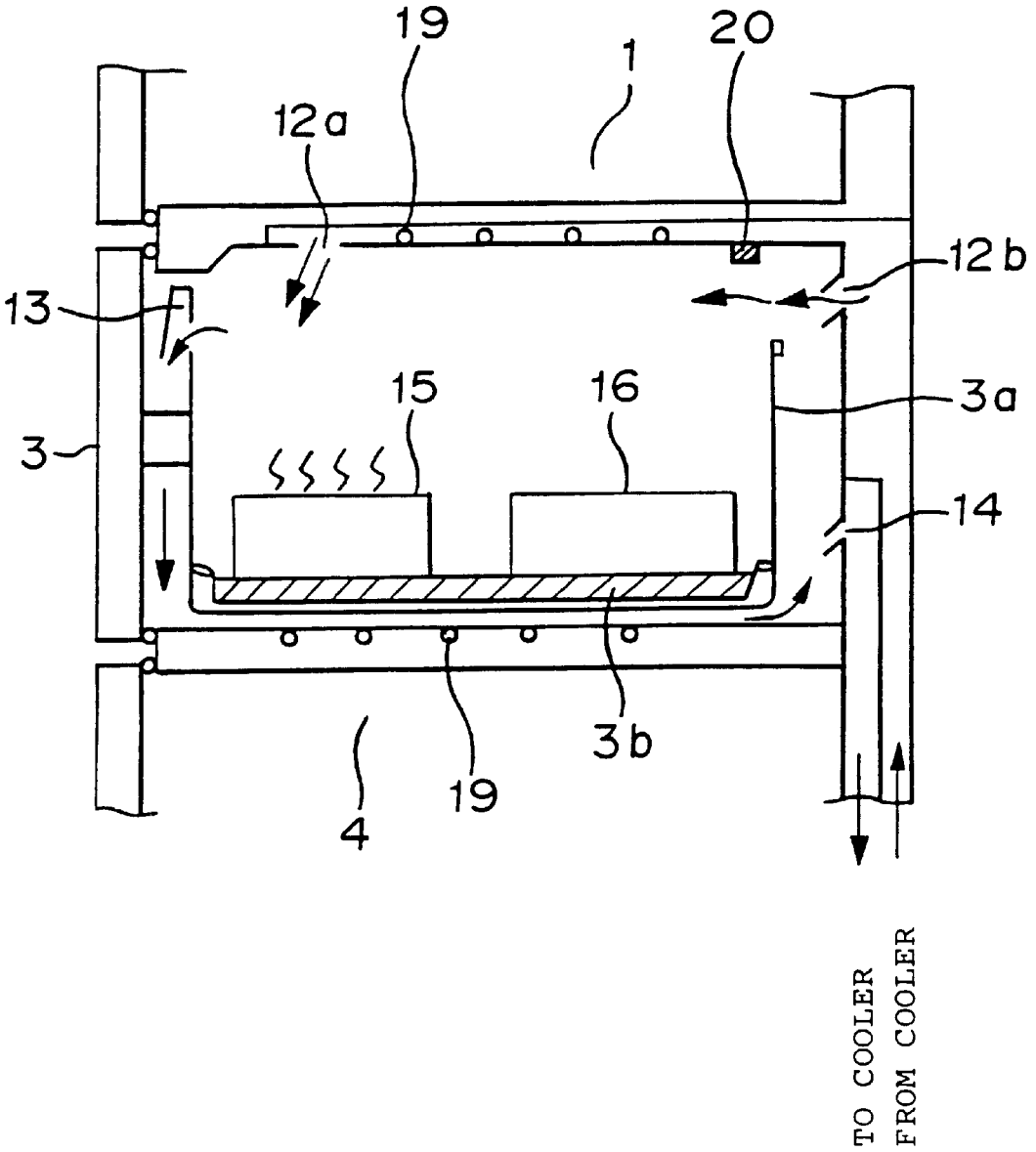
FIG. 7 is a cross-sectional view of the switching chamber of the refrigerator according to Embodiment 1 of the present invention.

A judgment of a condition of the food whether or not the food is in the set temperature will be described. FIG. 7 is a cross-sectional view of the switching chamber of the refrigerator. Description of numerical references similar to those illustrated in FIG. 6 is omitted. Numerical reference 19 designates a heater. Numerical reference 20 designates an infrared sensor.

When it is required to make an ice cream a temperature suitable for eating, for example, the temperature suitable for eating is set to be −10° C. by the temperature controller 7, and the ice cream taken out of the freezing chamber is inserted into the switching chamber 3. Because the ice cream is stored in the freezing chamber at −18° C. as a result of a detection of a temperature of the ice cream by the infrared sensor 20, the microcomputer judges that the temperature of the ice cream is lower than the set temperature of −10° C. Electricity is applied to heaters 19 located in the ceiling portion and the bottom surface of the switching chamber 3 to warm an inside of the switching chamber 3. While warming, the temperature of the ice cream is detected by the infrared sensor 20 to check a difference from the set temperature. When the detected temperature becomes −10° C., it is informed by a buzzer. The detection is not limited to an infrared and may be a microwave. It is sufficient that the infrared sensor 20 operates at only a required time, wherein the infrared sensor 20 may be constantly operated or operated by a predetermined time.

Incidentally, when it is required to make beer a temperature suitable for drinking, the temperature suitable for drinking is set to be 6° C., and the beer is inserted into the switching chamber 3. If the beer, stored under a room temperature in a similar manner to that described above is 20° C., the microcomputer judges that a cooling operation is necessary based on a difference from the detected temperature, performs the cooling operation until the detected temperature equals to the set temperature, and informs by the buzzer after a predetermined time from the equalized state and a state that the detected temperature is closer to the set temperature.

In the above example of the ice cream inside the switching chamber 3, the ice cream is heated to the temperature suitable for heating after thawing. A similar effect thereto is obtainable by changing a temperature setting from a high side to a low side.

Further, if it is necessary to quickly conduct the above operation, it is possible to quickly freeze or cool by pushing a quick freezing switch or immediately heating foods and so on by pushing a switch for a quick heating function.

As described, the refrigerator according to the present invention has advantages that the temperature inside the refrigerator can be easily set, a current temperature can be easily checked and set, the setting is not erroneously conducted because children and so on can not easily play with the refrigerator, and foods can be prevented from being frozen and rotted.

Further, because it is easy to check the temperature at time of opening and closing the door, a way of using the refrigerator can be taken care of, for example the temperature is increased by opening of the door for a long time, and there is an effect of saving energy in an aspect of the usage because a minute temperature control is possible besides preserving capability.

Further, because the structure of the refrigerator is seldom broken in a daily use, the refrigerator can be used with a relief.

Further, it is possible to set the quick cooling function for a required time, a labor time for house holding can be shortened by utilizing the temperature range of soft freezing, a nutrient of the food can be prevented from reducing, and a taste can be maintained.

Figure 8:
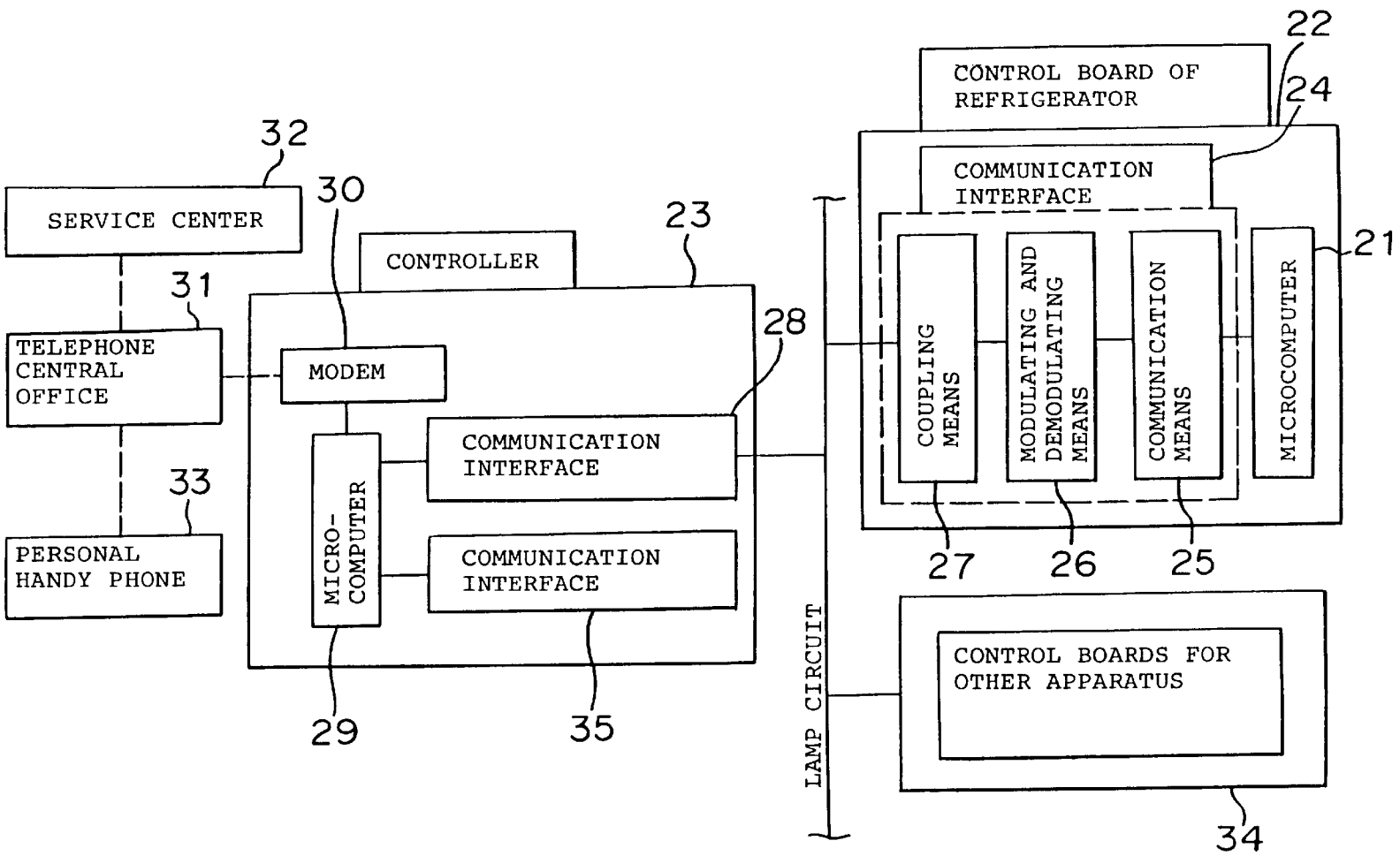
FIG. 8 is a circuit diagram illustrating an example of a communication means for illustrating Embodiment of the present invention.

Although the temperature controller 7 is attached to the door of the refrigerator 1, it is possible to separate the temperature controller 7 as a remote controller. If the remote controller is positioned at a place, such as a working space and so on of the kitchen, which can be observed while working, it is possible to check the time of quick cooling, the temperature, and so on without looking at the refrigerator. Further, the temperature of the refrigerator can be set by the remote controller without going to the refrigerator and with staying apart from the refrigerator. Needless to say that the remote controller, which can be detached from the refrigerator, may be controlled in a state that the remote controller is attached to the refrigerator. The remote controller may be operated using an infrared signal or a radio signal, In the next, information of the refrigerator may be taken in by, for example, a connecting method illustrated in FIG. 8. FIG. 8 is a circuit diagram in case of using a lamp circuit for supplying an electric power to the refrigerator as a communication method. In FIG. 8, numerical reference 22 designates a control board of the refrigerator, connected to the lamp circuit through a microcomputer 21 and a communication interface 24. The communication interface 24 is formed by, for example, the communication method 25, a modulating and demodulating means 26, and a coupling means 27. Further, numerical reference 23 designates a controller including a communication interface 28, a microcomputer 29, and a modem 30, the controller is located in an outdoor or an indoor of each form. Numerical reference 31 designates a telephone central office; numerical reference 32 designates a service center; and numerical reference 33 designates a portable handy phone.

Numerical reference 21 is the microcomputer, i.e. a control means, equipped in the refrigerator, the microcomputer memorizes an operation control and the information, e.g. the temperature, the state of the set temperature, and so on, of the refrigerator. Numerical reference 25 designates the communication means, which configurates a transmitting telegram upon a command of the control means, selects receiving telegrams, and commands the control means 21. The telegram is schematically consisting of a senders address, a receivers address, and a content. Numerical reference 26 is the modulating and demodulating means, which modulates a digital signal from the control means 21 into an analogue signal. Further, the modulating and demodulating means modulates an analogue signal from the lamp circuit or an electric power line into a digital signal. A modulating method is, for example, an amplitude modulation method or a phase modulation method. A communication frequency band through a lamp circuit is 50 kHz through 450 kHz in accordance with a law about electromagnetic waves. The coupling means 27 is a circuit including a transformer and so on, which brings the signal from the control means 21 in the lamp circuit or the electric power line. Further, the signal in the lamp circuit or the electric power line is taken out and transmitted to the control means 21.

Although a case that the lamp circuit is used as the communication means has been described, an effect similar thereto is obtainable when the internet and an E-mail using existing telephone and ISDN lines, radio communications, infrared communications, satellite communications and so on.

In case that the radio communications or the infrared communications are used as the communication means, by equipping the communication interface 35 for the radio communications or the infrared communications in the controller 23, it is judged which communication interface corresponds to telegrams of a certain equipment using both of the radio communications or the infrared communications and the lamp circuit communications, and a result is notified to the service center 32 and the portable handy phones 33. Further, when a command is received from the,service center 32 and the portable handy phone 33 in a manner adverse thereto, a content of the command is transmitted to various equipments by the microcomputer 29 in the controller 23 through the communication interfaces 28 and 35.

When the internet is used as the communication means, a device for connecting to the internet, such as a modem, is built in, for example, an inside of the door, and a monitor for setting an connection with the internet and so on is located at a portion enabling an operation of the monitor and being in vicinity of the hand, which is formed in the door and protruding from the door. By locating the monitor in the vicinity of the hand, a protruding portion of the secure hand works as a guard at time of opening the door, whereby the monitor is prevented from being damaged even though the door strikes against obstacles such as a wall, whereby the refrigerator having high reliability is obtainable. The connecting portion with the telephone lines and the ISDN lines may not be located in the door and may be located on a back surface and side surfaces of a refrigerator body as long as the connection is not troubled.

Numerical reference 34 designates a control board for other apparatuses, which controls an operation of the other refrigerators and electric appliances other than the refrigerator such as an air conditioner.

By virtue of the above-mentioned network system, the following services become available.

A malfunction of the refrigerator is quickly recognized by a regular checking of a running condition and temperature data of the refrigerator by the service center. A customer need not to request a repair after the refrigerator does not cool, and a satisfactory service of constantly checking the refrigerator by a maker can be provided. A retail shop contracting about a stock can check the stock and deliver supplements of goods directly to a home. Further, it becomes possible to check a content of the refrigerator in the home from an outside of the home by a personal computer, a personal handy phone, and so on and buy necessary items. Goods, stored in the switching chamber, can be stored by freezing in the morning and thawed by a time of returning the home through a personal computer in an outside of the home, the personal handy phone, and so on so that the temperature is set to be in a chilled state for thawing. Further, in case that the time of arriving the home is suddenly changed and other cases, it is necessary to change the previously set state. The setting can be easily changed from the outside of the home by the personal handy phone and so on.

As described, operations, which can not be generally conducted by directly accessing a refrigerator, now can be conducted from a location apart from the refrigerator, whereby a job by a user is eliminated.

By using the system illustrated in FIG. 8, the information can be easily obtained, and the settings of the temperature, the temperature change, and so on can be freely conducted in use of a network system, which can be installed in an already constructed house at a low cost.

The first advantage of the refrigerator according to the present invention is that the display of the temperature controller can be easily observed, and an erroneous operation and a breakage of the temperature controller are prevented.

The second advantage of the refrigerator according to the present invention is that the temperature controller can be easily operated.

The third advantage of the refrigerator according to the present invention is that it is possible to prevent the temperature controller from striking against walls and furnitures, both of which are located around the refrigerator.

The fourth advantage of the refrigerator according to the present invention is that an erroneous operation of the temperature controller, for example, an erroneous setting of a temperature for a wrong chamber, can be prevented.

The fifth advantage of the refrigerator according to the present invention is that the temperature controller can be easily operated by positioning the display portion so as not to be covered by a hand operating the temperature controller.

The sixth advantage of the refrigerator according to the present invention is that the display portion of the temperature controller can be accurately displayed.

The seventh advantage of the refrigerator according to the present invention is that a minute temperature control becomes possible.

The eighth advantage of the refrigerator according to the present invention is that foods previously stored in the refrigerator is not heated when a warm food is stored.

The ninth advantage of the refrigerator according to the present invention is that the refrigerator is not excessively cooled.

The tenth advantage of the refrigerator according to the present invention is that foods can be quickly frozen inconformity with types of the foods.

The eleventh advantage of the refrigerator according to the present invention is that it is possible to control the refrigerator from a position apart from the refrigerator.

The twelfth advantage of the refrigerator according to the present invention is that the preserving chamber is automatically set to have a requisite temperature condition if a user does not set a temperature.

The thirteenth advantage of the refrigerator according to the present invention is that foods are automatically rendered a cookable condition.

The fourteenth advantage of the refrigerator according to the present invention is that the temperature of the refrigerator can be set without directly accessing the refrigerator.

The fifteenth advantage of the refrigerator according to the present invention is that cooling seldom causing a change of taste and a decrement of food value can be automatically performed.

The sixteenth advantage of the refrigerator according to the present invention is that foods are cooled or heated when it is necessary.

Obviously, numerous modifications and variations of the present invention are possible in light of the above teachings. It is therefore to be understood that within the scope of the appended claims, the invention may be practiced otherwise than as specifically described herein.

The entire disclosure of Japanese Patent Application JP11-255543 filed on Sep. 9, 1999 and JP11-366517 filed on Dec. 24, 1999 including specification, claims, drawings and summary are incorporated herein by reference in its entirety.

What is claimed is:

1. A refrigerator comprising:

a cold heat accumulator located on a lower surface of a casing accommodating foods and so on, which are stored in a quick freezing chamber, wherein a cooling air, introduced from a cooler, is subjected to forced convection between an upper portion of a back surface of the casing and an upper portion of a front surface of the casing.

* * * * *